US009528768B2

(12) United States Patent
Schoenfeld et al.

(10) Patent No.: US 9,528,768 B2
(45) **Date of Patent: *Dec. 27, 2016**

(54) TEST STAND AND METHOD FOR TESTING FLUID PUMPS AND FLUID INJECTORS

(75) Inventors: Dirk Schoenfeld, Altbach (DE); Kurt Blank, Ebersbach (DE); Karl Kastner, Eningen (DE); Daniel Strack, Uhingen (DE)

(73) Assignee: Robert Bosch GmbH, Stuttgart (DE)

( * ) Notice: Subject to any disclaimer, the term of this patent is extended or adjusted under 35 U.S.C. 154(b) by 839 days.

This patent is subject to a terminal disclaimer.

(21) Appl. No.: 13/810,535

(22) PCT Filed: Jun. 6, 2011

(86) PCT No.: PCT/EP2011/059277

§ 371 (c)(1),
(2), (4) Date: Mar. 29, 2013

(87) PCT Pub. No.: WO2012/007229

PCT Pub. Date: Jan. 19, 2012

(65) Prior Publication Data

US 2013/0186605 A1 Jul. 25, 2013

(30) Foreign Application Priority Data

Jul. 16, 2010 (DE) ..... 10 2010 031 481

(51) Int. Cl.
*F28D 1/00* (2006.01)
*F02M 53/00* (2006.01)
*F02M 65/00* (2006.01)

(52) U.S. Cl.
CPC ..... *F28D 1/00* (2013.01); *F02M 53/00* (2013.01); *F02M 65/00* (2013.01); *F02M 65/001* (2013.01)

(58) Field of Classification Search
CPC ..... F02M 53/00; F02M 65/001; F02M 65/00; F28D 1/00

(Continued)

(56) References Cited

U.S. PATENT DOCUMENTS 4,214,476 A * 7/1980 Koster ..... G05D 23/22 73/114.41
4,404,847 A * 9/1983 Larson ..... F02M 55/00 73/114.42

(Continued)

FOREIGN PATENT DOCUMENTS

DE 10 2006 013 634 9/2007
DE 102006013634 A1 * 9/2007 ..... F02M 65/002

(Continued)

OTHER PUBLICATIONS

International Search Report, PCT International Application No. PCT/EP2011/059277, dated Aug. 8, 2011.

*Primary Examiner* — Hezron E Williams
*Assistant Examiner* — Marrit Eyassu
(74) *Attorney, Agent, or Firm* — Norton Rose Fulbright US LLP; Gerard Messina

(57) ABSTRACT

A test stand for testing a fluid injection pump and/or a fluid injector has a device for conditioning a test fluid used for the testing. The device has a tank to accommodate and store the test fluid, a first fluid removal line to withdraw test fluid from the tank and to convey it to the fluid injection pump, and a cooling circuit for cooling the test fluid stored inside the tank. The cooling circuit has a second fluid removal line and a return line. The fluid removal line is to withdraw test fluid from the tank and is connected to a heat exchanger, which cools the test fluid withdrawn from the tank. The return line is connected to the heat exchanger and returns the test fluid from the heat exchanger back into the tank.

9 Claims, 1 Drawing Sheet

(58) Field of Classification Search
USPC ..... 73/114.45, 114.41, 116.01
See application file for complete search history.

(56) References Cited

U.S. PATENT DOCUMENTS

| | | | | | |
|---|---|---|---|---|---|
| 4,712,421 | A * | 12/1987 | Young | F02M 65/00 | 73/114.45 |
| 4,872,438 | A | 10/1989 | Ausiello et al. | | |
| 5,000,043 | A * | 3/1991 | Bunch, Jr. | F02M 65/00 | 73/114.46 |
| 6,234,151 | B1 | 5/2001 | Eck | | |
| 6,647,769 | B1 * | 11/2003 | Fujino | F02B 61/045 | 73/114.41 |
| 2005/0150480 | A1 * | 7/2005 | Hoffmann | F02M 31/20 | 123/459 |

FOREIGN PATENT DOCUMENTS

| | | |
|---|---|---|
| GB | 1 135 234 | 12/1968 |
| GB | 0714499 | 6/1996 |
| GB | 2 451 262 | 1/2009 |
| JP | 55-117069 | 9/1980 |

* cited by examiner

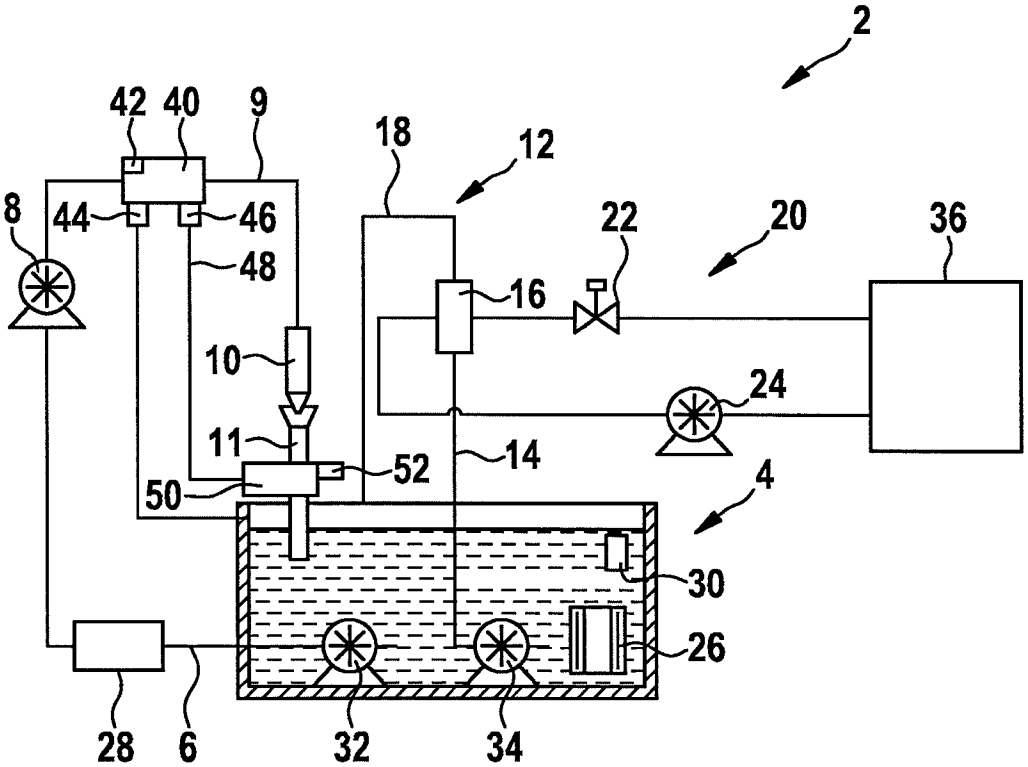
2
36
20
24
4
22
30
26
12
16
14
34
18
52
32
9
46
48
10
11
40
50
6
42
44
28
8

TEST STAND AND METHOD FOR TESTING FLUID PUMPS AND FLUID INJECTORS

FIELD

The present invention relates to a test stand and to a method for testing a fluid pump and/or a fluid injector, having a device for conditioning the test oil used for the testing.

BACKGROUND INFORMATION

For testing fluid pumps, especially high-pressure fuel pumps, and fluid injectors (fuel injectors) in a test stand, the fluid used for the testing (test oil) should have a defined temperature. Depending on the prevailing ambient and operating conditions, this requires that the employed fluid be heated or cooled.

Conventionally, the fluid removed from a tank is routed through a heat exchanger in order to cool it prior to conveying it to the fluid pump.

In addition, a heater is frequently provided in the fluid tank so as to heat the fluid, if necessary.

SUMMARY

It is an object of the present invention to provide an improved test stand and an improved method for testing a fluid injection pump and/or a fluid injector, which allow(s) better conditioning of the fluid used for the testing.

A test stand according to the present invention has a tank for accommodating and storing the fluid, and a first fluid removal line, which is developed to withdraw fluid from the tank and to convey it to a fluid injection pump to be tested, which may be a high-pressure fuel pump, in particular.

A test stand according to the present invention has a first cooling circuit for cooling the fluid stored in the tank; the first cooling circuit has a first fluid removal line, which is developed to withdraw fluid from the tank and is hydraulically connected to a heat exchanger, so that fluid removed from the tank during operation is conveyed to the heat exchanger. The heat exchanger is suitable for cooling the fluid removed from the tank. The first cooling circuit additionally has a return line, which is connected to the heat exchanger and developed to return fluid which has traveled through the second fluid removal line from the tank into the heat exchanger, back into the tank.

A method according to the present invention for testing a fluid injection pump and/or a fluid injector includes the steps of: conditioning, in particular adjusting the temperature, of a fluid stored in a tank, and withdrawing the conditioned fluid from the tank in order to convey it to a fluid injection pump, which then supplies the fluid to the fluid injector to be tested at increased pressure. The fluid conditioning includes the following steps: withdrawing the fluid from the tank; cooling the fluid in a heat exchanger; and returning the cooled fluid to the tank.

By adjusting the temperature of the fluid in the tank, a test stand according to the present invention and a method according to the present invention enable better conditioning of the fluid. Since the fluid quantity in the tank has greater thermal capacity than the fluid quantity which is routed through the heat exchanger disposed directly upstream from the fluid injection pump in a conventional method, temperature fluctuations of the fluid in the intake to the fluid injection pump are able to be reduced. On the one hand, it is possible to satisfy higher demands regarding the temperature stability in the testing of fluid injection pumps and fluid injectors, in particular high-pressure fuel pumps and fuel injectors, as they are used in Diesel engines, in particular. On the other hand, given the same requirements concerning temperature stability, the heat exchanger may have smaller dimensions than previously, so that the production cost and the required space are able to be reduced.

The thermal energy $E=m*c*T$ of the test fluid stored in the tank is considerably greater than the thermal energy of the volume flow through the heat exchanger of a conventional device. A tank as it is typically used in a test stand includes fluid that has a mass of approximately 40 kilograms. In testing operations during testing at a high pump delivery output, this mass corresponds to a delivery period of approx. 10 minutes, and during testing at a lower pump delivery output, to a delivery period of approx. 20 minutes.

In a temperature adjustment of the fluid in the tank, an approximately 50% smaller volume flow through the heat exchanger and a heat exchanger having correspondingly smaller dimensions than in a conventional method are sufficient to keep the temperature of the fluid constant at the same quality as in a conventional method.

In one specific embodiment, a second cooling circuit is provided, which is connected to the heat exchanger and designed to cool the fluid flowing through the heat exchanger. With the aid of a second cooling circuit, the fluid is able to be cooled in effective and cost-advantageous manner.

In one specific embodiment, a control valve is provided in the second cooling circuit, which is suitable for regulating the coolant flow within the second cooling circuit. By controlling the coolant flow in the second cooling circuit, the cooling power of the second cooling circuit is adjustable. It is possible, in particular, to adjust the temperature of the fluid in the tank to a desired value.

In one specific embodiment, a coolant pump is disposed in the second cooling circuit, which is designed to facilitate the circulation of coolant through the cooling circuit. Such a pump, which aids in circulating coolant through the second cooling circuit, is able to increase the efficiency of the cooling circuit.

In one specific embodiment, the coolant circulating in the second cooling circuit is water. Water is an effective and inexpensive coolant.

In one specific embodiment, a heater which is suitable for heating the fluid stored inside the tank is situated inside the tank. A heater mounted inside the tank makes it possible to adjust the desired temperature of the fluid in the tank even if the desired value lies above the actual fluid temperature or the ambient temperature.

In one specific embodiment, a temperature sensor which is designed to measure the temperature of the fluid is situated in the first fluid removal line and/or inside the tank. Measuring the temperature of the fluid makes it possible to adjust a desired fluid temperature in an especially efficient and precise manner.

A measurement of the fluid temperature inside the first fluid removal line provides an especially precise value of the temperature of the fluid conveyed to the fluid injection pump. Measuring the temperature of the fluid inside the tank allows a particularly efficient and precise control of the coolant circuit and/or the heater in order to adjust the temperature of the fluid inside the tank.

One specific embodiment of a method according to the present invention also includes a regulation of the cooling and/or heating of the fluid in the tank on the basis of the measured temperature.

The present invention is explained in detail below with reference to the FIGURE.

BRIEF DESCRIPTION OF THE DRAWING

The FIGURE shows a schematic view of an example device according to the present invention for conditioning and, in particular, adjusting the temperature, of a fluid used for testing a fluid injection pump and/or a fluid injector.

DETAILED DESCRIPTION OF EXAMPLE EMBODIMENTS

A device 2 according to the present invention includes a tank 4, which is developed to accommodate and store the fluid to be conditioned.

A first fluid removal line 6 is provided for withdrawing fluid from tank 4 and for conveying it to a fluid injection pump 8. During operation, fluid injection pump 8 increases the pressure of the fluid withdrawn from tank 4 and conducts the fluid to a pressure reservoir (test rail) 40. The pressure in pressure reservoir 40 is able to be measured by at least one pressure sensor 42 situated inside pressure reservoir 40 and is able to be adjusted to the desired value very precisely by controlling a pressure adjustment valve 44, through which excess fluid from pressure reservoir 40 is able to be returned to tank 4.

Via fluid pressure line 9, pressure reservoir 40 is hydraulically connected to a fluid injector 10 to be tested, in order to supply pressurized fluid to fluid injector 10 during operation.

The fluid output by fluid injector 10 during testing operation is caught by a collection device 11 and returned to tank 4 through a fluid measuring unit 50. Fluid-measuring unit 50 is equipped with an evaluation and display unit 52, which is designed to analyze and display the fluid quantities measured by fluid measuring unit 50, and/or to transmit this information to a diagnosis unit (not shown).

In addition, pressure reservoir 40 is hydraulically connected to fluid-measuring unit 50 via a bypass line 48, which is able to be closed with the aid of a bypass valve 46. Bypass valve 46 is closed while fluid injector 10 is tested. To test fluid injection pump 8, bypass valve 46 is opened and fluid injector 10 is not triggered, so that fluid measuring unit 50 measures the fluid quantity supplied by fluid injection pump 8.

A first fluid supply pump 32, which is provided inside tank 4 in first fluid removal line 6, is designed to aid in the removal of fluid from tank 4 and to supply the withdrawn fluid to fluid injection pump 8. In an exemplary embodiment that is not shown, first fluid supply pump 32 is situated outside of tank 4, in first fluid removal line 6.

In addition, a first temperature sensor 28 is provided in first fluid removal line 6; this sensor is suitable for measuring the temperature of the fluid withdrawn from tank 4 via first fluid removal line 6 and for forwarding the measuring result to a control device (not shown).

Situated inside tank 4 is a heater 26, which is actuable by the control device (not shown) in order to increase the temperature of the fluid in tank 4, if appropriate.

A first cooling circuit 12 having a second fluid removal line 14 is provided, which is designed to withdraw fluid from tank 4 and to supply it to a heat exchanger 16. In addition, a return line 18 is connected to heat exchanger 16 so as to return fluid withdrawn from tank 4 via second fluid removal line 14 and routed through heat exchanger 16, back from heat exchanger 16 into tank 4.

A second fluid supply pump 34 designed to create a fluid flow from tank 4 through second fluid removal line 14, heat exchanger 16 and return line 18, is provided in second fluid removal line 14, inside tank 4. In one exemplary embodiment (not shown), second fluid supply pump 34 is situated outside of tank 4, in second fluid removal line 14.

The control device (not shown) also actuates second fluid supply pump 34 in order to regulate the temperature of the fluid inside tank 4, in particular in order to reduce the temperature of the fluid inside tank 4.

A second cooling circuit 20 is connected to heat exchanger 16; this cooling circuit is developed to transmit and discharge heat from the fluid flowing through heat exchanger 16 to a coolant that circulates through second cooling circuit 20, in order to cool the fluid inside heat exchanger 16. A coolant pump 24 is provided in second cooling circuit 20 to assist in the circulation of the coolant through second cooling circuit 20. In addition, a regulatable coolant valve 22 is provided, which is actuable by the control device (not shown), so as to regulate the coolant flow through second cooling circuit 20. In this way the cooling power of heat exchanger 16 is able to be set to the desired value via coolant valve 22.

Second cooling circuit 20 has a second heat exchanger 36, which, for example, is developed as cold water substitute so as to cool the coolant that was heated by the fluid in heat exchanger 16. With the aid of a sealed cooling circuit 20, the fluid is able to be cooled in effective, cost-advantageous and environmentally friendly manner.

A second temperature sensor 30, which is developed to measure the temperature of the fluid inside tank 4, is provided inside tank 4. This second temperature sensor 30 is preferably also connected to the control device (not shown).

The control device preferably has an input device, via which the fluid temperature desired for the individual testing procedure is able to be set. The control device controls second fluid supply pump 34, coolant pump 24, coolant valve 22 and heater 26 as a function of the temperature values measured by temperature sensors 28, 30 and transmitted to the control device, in such a way that the fluid inside tank 4 reaches the desired temperature as quickly as possible. The circulation of the fluid through first cooling circuit 12, which is brought about by second fluid supply pump 34, results in thorough mixing of the fluid inside tank 4, so that a uniform temperature level of the fluid in tank 4 is achieved.

The withdrawal location of the fluid where the fluid is removed from tank 4 via second fluid removal line 14 and conveyed to first cooling circuit 12, and the location where the cooled fluid is routed back into tank 4 via return line 18 is preferably implemented at points of tank 4 that are at a distance from each other in order to obtain particularly thorough mixing of the fluid in tank 4 and a particularly uniform temperature distribution inside tank 4.

What is claimed is:

1. A test stand for testing at least one of a fluid injection pump and a fluid injector, the test stand having a device for conditioning a test fluid used for the testing, the device comprising:

a tank to accommodate and store the test fluid;

a first fluid removal line situated to withdraw test fluid from the tank and to convey it to the fluid injection pump;

a first cooling circuit configured to cool the test fluid stored inside the tank, the first cooling circuit having a second fluid removal line situated to withdraw test fluid from the tank, a heat exchanger configured to cool the test fluid removed from the tank and connected to the second fluid removal line, and a return line connected to the heat exchanger and situated to return the test fluid from the heat exchanger back into the tank; and a second, closed cooling circuit connected to the heat exchanger and configured to cool the test fluid flowing through the heat exchanger during operation, wherein the second cooling circuit circulates a coolant which is separate from the test fluid.

2. The test stand as recited in claim 1, further comprising:

a control valve provided in the second cooling circuit, the control valve to regulate a coolant flow through the cooling circuit.

3. The test stand as recited in claim 1, wherein a coolant pump is situated in the second cooling circuit, and the coolant pump is to support a circulation of coolant through the cooling circuit.

4. The test stand as recited in claim 1, further comprising:

a heater situated in the tank, the heater to heat the test fluid stored inside the tank.

5. The test stand as recited in claim 1, wherein at least one temperature sensor is situated at least one of in the first fluid removal line, and inside the tank, the temperature sensor to measure a temperature of the test fluid.

6. A method for testing at least one of a fluid injection pump and a fluid injector, comprising:

conditioning a test fluid stored inside a tank;

withdrawing the conditioned test fluid from the tank to convey it to the fluid injection pump, which supplies the test fluid to the fluid injector under increased pressure;

wherein the conditioning of the test fluid includes withdrawing test fluid from the tank, conducting the withdrawn test fluid through a heat exchanger, and returning the withdrawn test fluid to the tank, wherein a closed cooling circuit is connected to the heat exchanger and is configured to cool the test fluid flowing through the heat exchanger during operation, and wherein the closed cooling circuit circulates a coolant which is separate from the test fluid.

7. The method as recited in claim 6, further comprising:

heating the test fluid inside the tank.

8. The method as recited in claim 6, further comprising:

measuring a temperature of the test fluid.

9. The method as recited in claim 8, further comprising:

regulating a cooling and heating of the test fluid on the basis of the measured temperature.

* * * * *